US012454430B2

(12) United States Patent
Shirasaki

(10) Patent No.: US 12,454,430 B2
(45) Date of Patent: Oct. 28, 2025

(54) IMAGE PROCESSING APPARATUS AND IMAGE PROCESSING METHOD

(71) Applicant: KYOCERA Document Solutions Inc., Osaka (JP)

(72) Inventor: Seiichi Shirasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 203 days.

(21) Appl. No.: 18/450,691

(22) Filed: Aug. 16, 2023

(65) Prior Publication Data

US 2024/0059517 A1 Feb. 22, 2024

(30) Foreign Application Priority Data

Aug. 17, 2022 (JP) ..... 2022-129869

(51) Int. Cl.
*B65H 9/00* (2006.01)
*B65H 5/06* (2006.01)
*B65H 29/12* (2006.01)

(52) U.S. Cl.
CPC ..... *B65H 9/006* (2013.01); *B65H 5/062* (2013.01); *B65H 29/125* (2013.01); *B65H 2301/331* (2013.01); *B65H 2513/10* (2013.01); *B65H 2513/20* (2013.01)

(58) Field of Classification Search
CPC . B65H 29/125; B65H 9/006; B65H 2301/331
See application file for complete search history.

(56) References Cited

U.S. PATENT DOCUMENTS 7,063,472 B2 * 6/2006 Matsuda ..... B65H 9/008 400/582
7,575,230 B2 * 8/2009 Kamiya ..... G03G 15/6573 270/58.1
2019/0062093 A1 * 2/2019 Inoue ..... B65H 5/062

FOREIGN PATENT DOCUMENTS

JP 2008285239 A 11/2008

* cited by examiner

*Primary Examiner* — Patrick Cicchino
(74) *Attorney, Agent, or Firm* — Alleman Hall & Tuttle LLP

(57) ABSTRACT

An image processing apparatus includes a registration roller, a first conveying roller, and a second conveying roller. The registration roller is disposed on a conveying path of a sheet to be subjected to image processing, and corrects the skew of the sheet by allowing the leading end of the sheet abut thereon in a stopped state. The first conveying roller is disposed upstream of the registration roller on the conveying path at a position where a first loop space for deflecting the sheet is interposed between the first conveying roller and the registration roller. The second conveying roller is disposed upstream of the first conveying roller at a position where a second loop space is interposed between the two conveying rollers. The second conveying roller conveys the sheet at a conveying speed that is equal to or higher than the conveying speed of the first conveying roller.

6 Claims, 8 Drawing Sheets

IMAGE PROCESSING APPARATUS AND IMAGE PROCESSING METHOD

INCORPORATION BY REFERENCE

This application is based upon and claims the benefit of priority from the corresponding Japanese Patent Application No. 2022-129869 filed on Aug. 17, 2022, the entire contents of which are incorporated herein by reference.

The present disclosure relates to an image processing apparatus and an image processing method.

BACKGROUND

As related art, there is known an image processing apparatus (image forming system) provided with a sheet conveying device that drives a registration roller after having the leading end of a sheet (paper) abut on a nip portion of the registration roller in a stopped state and correcting the skew of the sheet (aper skew correction). In the image processing apparatus according to the related art, a loop roller for deflecting a sheet is disposed upstream of the registration roller, and when the skew of the sheet is corrected, whether or not to stop the driving of the loop roller or whether or not to decelerate the driving of the loop roller is controlled depending on the type of the sheet.

SUMMARY

An image processing apparatus according to one aspect of the present disclosure includes a registration roller, a first conveying roller, and a second conveying roller. The registration roller is disposed on a conveying path of a sheet to be subjected to image processing, and corrects the skew of the sheet by allowing the leading end of the sheet to abut thereon in a stopped state. The first conveying roller is disposed upstream of the registration roller on the conveying path at a position where a first loop space for deflecting the sheet is interposed between the first conveying roller and the registration roller. The first conveying roller conveys the sheet at a first conveying speed. The second conveying roller is disposed upstream of the first conveying roller on the conveying path at a position where a second loop space for deflecting the sheet is interposed between the second conveying roller and the first conveying roller. The second conveying roller conveys the sheet at a second conveying speed that is equal to or higher than the first conveying speed.

An image processing method according to another aspect of the present disclosure includes: driving a registration roller disposed on a conveying path of a sheet to be subjected to image processing and configured to correct a skew of the sheet by allowing a leading end of the sheet to abut thereon in a stopped state; driving a first conveying roller disposed upstream of the registration roller on the conveying path at a position where a first loop space for deflecting the sheet between the first conveying roller and the registration roller and configured to convey the sheet at a first conveying speed; and driving a second conveying roller disposed upstream of the first conveying roller on the conveying path at a position where a second loop space for deflecting the sheet is interposed between the second conveying roller and the first conveying roller and configured to convey the sheet at a second conveying speed that is equal to or higher than the first conveying speed.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Embodiments of the present invention will be described below with reference to the accompanying drawings. The following embodiments are examples of embodying the present invention and do not limit the technical scope of the present invention.

First Embodiment

[1] Overall Configuration of Image Processing Apparatus

First, an overall configuration of an image processing apparatus 10 according to the present embodiment will be described with reference to FIG. 1 and FIG. 2.

The image processing apparatus 10 according to the present embodiment is, for example, a multifunction peripheral having a plurality of functions such as a scanning function for obtaining image data from a document sheet, a printing function for forming an image based on the image data, a facsimile function, and a copy function. The image processing apparatus 10 may be a printer, a scanner, a facsimile machine, a copier, or the like as long as it has an image processing function including at least one of the function of forming an image and the function of obtaining image data.

Figure 2:
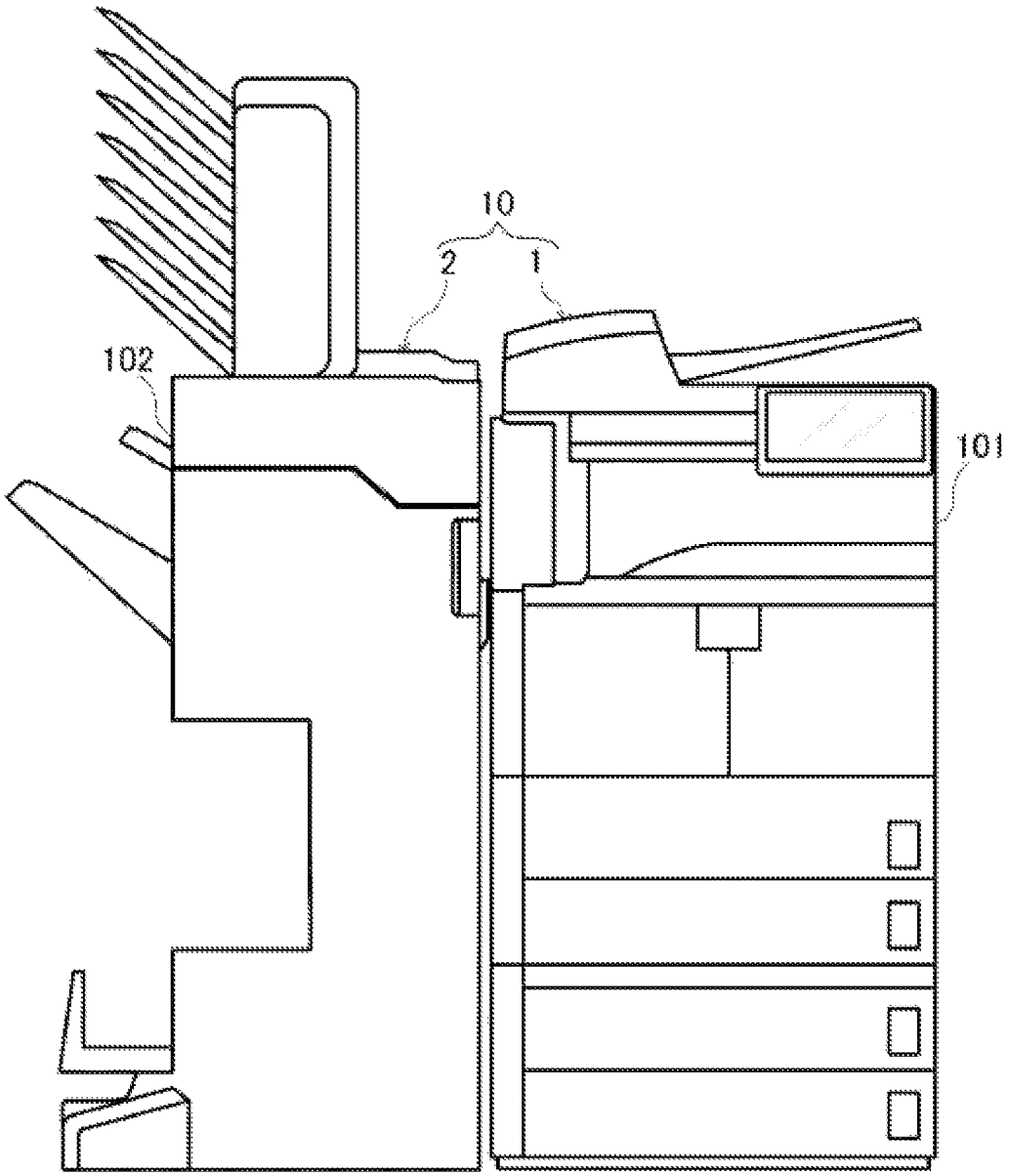
FIG. 2 is a schematic diagram showing the exterior of the image processing apparatus according to the first embodiment.

As shown in FIG. 2, the image processing apparatus 10 is roughly composed of a main body 1 (main body unit) and an extension device 2 (enhancement unit). The main body 1 has an image processing function (at least one of the function of forming an image and the function of obtaining image data).

The "extension device" in the present disclosure is an optional device detachably connected to the main body 1, and is an enhancement that adds various extended functions to the image processing apparatus. The main body 1 and the extension device 2 are used in a state of being electrically and mechanically connected.

That is, while having the functions of the main body 1 as basic functions, the image processing apparatus 10 can implement various extended functions desired by the user by combining the main body 1 with desired extension devices 2. In other words, the image processing apparatus 10 includes the main body 1 having the image processing function, and an extension device 2 is detachably connected to the main body 1. Specific examples of the extension device 2 include devices such as a stapling machine, a folding machine, an inserter, a booklet folder, and a mail folder. These extension devices 2 are "post-processing devices" that perform post-processing, such as stapling, on sheets on which images have been formed in the main body 1.

In the present embodiment, as an example, the image processing apparatus 10 includes a finisher (post-processing device) having a function as a stapling machine as the extension device 2, and further includes any extension device 2 selected from a folding machine, an inserter, a booklet folder, a mail folder, and the like. That is, the image processing apparatus 10 can connect one or more extension devices 2 to one main body 1.

Figure 1:
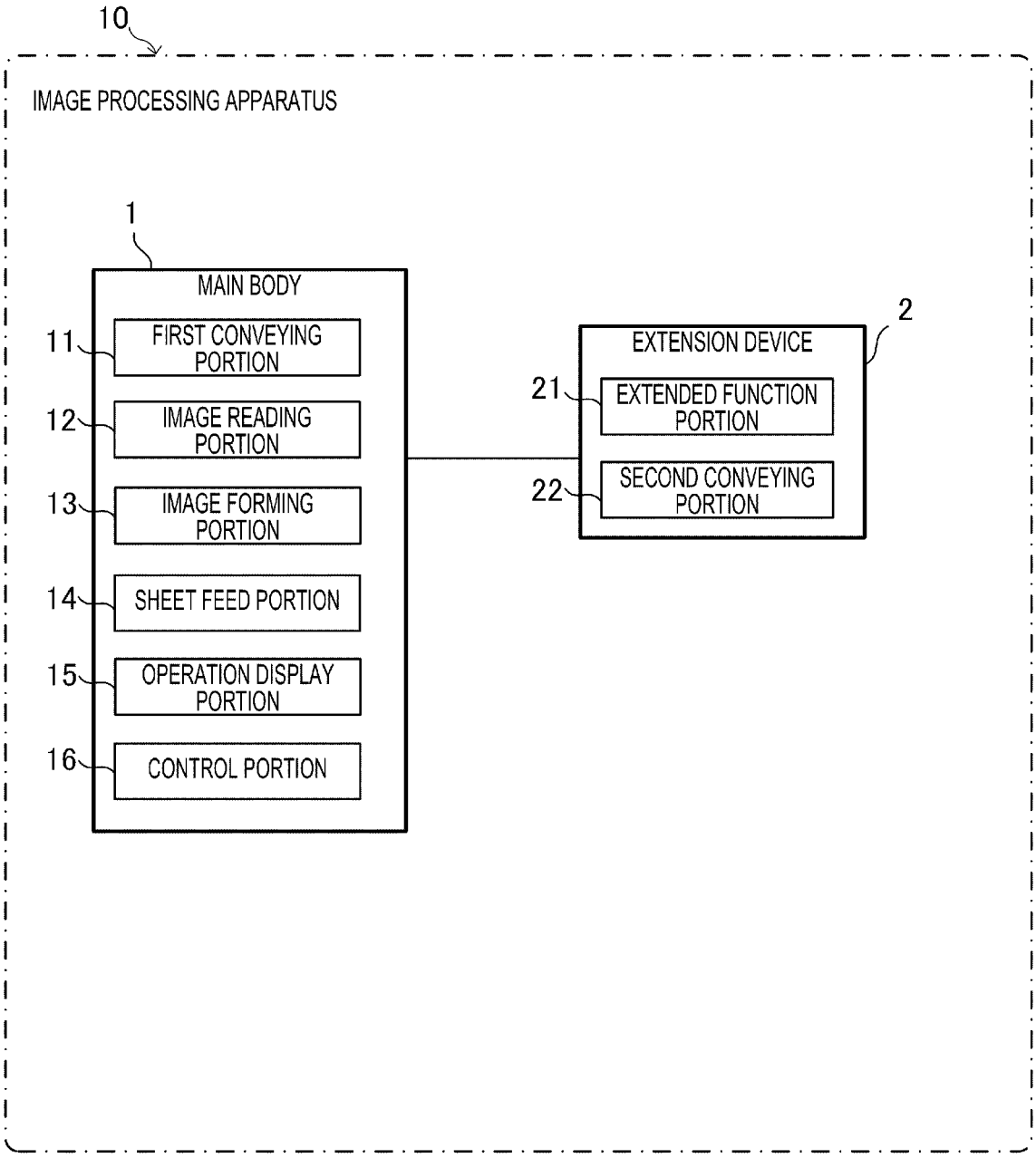
FIG. 1 is a schematic block diagram of an image processing apparatus according to a first embodiment.

As shown in FIG. 1, the main body 1 includes a first conveying portion 11, an image reading portion 12, an image forming portion 13, a sheet feed portion 14, an operation display portion 15, and a control portion 16. In the present embodiment, as shown in FIG. 2, the main body 1 includes a housing 101. The first conveying portion 11, the image reading portion 12, the image forming portion 13, the sheet feed portion 14, the operation display portion 15, and the control portion 16 are provided in the housing 101.

Figure 3:
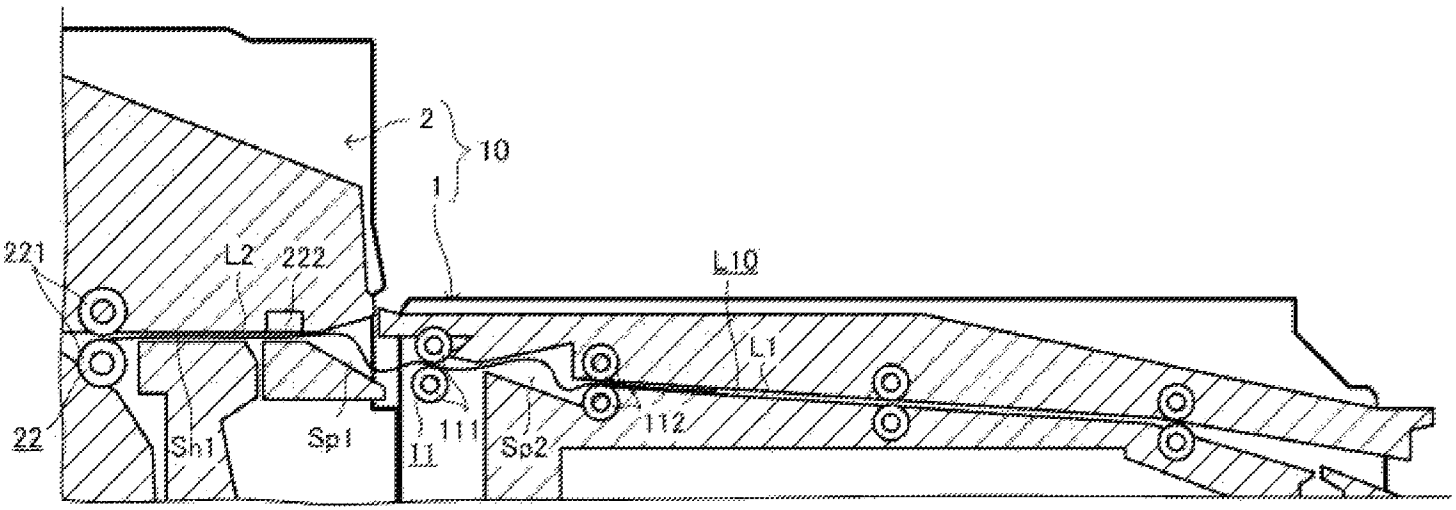
FIG. 3 is a schematic cross-sectional view showing a main part of the image processing apparatus according to the first embodiment.

The first conveying portion 11 conveys a sheet Sh1 (see FIG. 3) to be subjected to image formation or image reading along a first conveying path L1 (see FIG. 3). As will be described in detail later, the first conveying portion 11 sequentially conveys sheets Sh1 to be subjected to image processing (image formation or image reading) with one or more roller pairs disposed on the first conveying path L1 formed in the main body 1. Here, although the sheet Sh1 conveyed by the first conveying portion 11 is paper as an example, it is not limited to paper, and may be, for example, a resin film.

The image reading portion 12 reads an image from a document sheet (sheet Sh1) and outputs image data corresponding to the read image. The image reading portion 12 includes a document sheet table, a light source, a plurality of mirrors, an optical lens, a charge coupled device (CCD), and the like.

The image forming portion 13 forms an image on the sheet Sh1 using an electrophotographic method, based on the image data output from the image reading portion 12. In addition, the image forming portion 13 forms an image on the sheet Sh1 based on image data input from an information processing apparatus, such as a personal computer, external to the image processing apparatus 10. The image forming portion 13 includes four image forming units corresponding to four colors of C (cyan), M (magenta), Y (yellow), and K (black), a laser scanning unit, an intermediate transfer belt, a secondary transfer roller, a fixing device, and the like. The image forming portion 13 may form an image on the sheet Sh1 using an image forming method other than the electrophotographic method, such as an inkjet method.

The image forming portion 13 forms an image on the sheet Sh1 using toner as a developer. When the image forming portion 13 forms an image using an inkjet method, ink (another example of the developer) is supplied instead of the toner. Examples of the toner supplied to the image forming portion 13 include toners of a plurality of colors of C (cyan), M (magenta), Y (yellow), and K (black). The sheet Sh1 on which an image has been formed by the image forming portion 13 is conveyed by the first conveying portion 11 to the extension device 2 as a post-processing device for post-processing.

The sheet feed portion 14 supplies the sheet Sh1 to the image forming portion 13. The sheet feed portion 14 includes a sheet feed cassette, a manual feed tray, a sheet conveying path, and a plurality of conveying rollers. The image forming portion 13 forms an image on the sheet Sh1 supplied from the sheet feed portion 14.

The operation display portion 15 is a user interface in the image processing apparatus 10. The operation display portion 15 includes a display portion, such as a liquid crystal display, for displaying various types of information in response to a control instruction from a control portion of the main body, and an operation portion, such as a switch or a touch panel, for inputting various types of information to the control portion of the main body in response to a user's operation. In addition, the image processing apparatus 10 may include, as a user interface, an audio output portion, an audio input portion, and the like, in addition to or instead of the operation display portion 15.

The control portion 16 comprehensively controls the image processing apparatus 10. In the present embodiment, the control portion 16 controls at least the first conveying portion 11 of the main body 1 and a second conveying portion 22 of the extension device 2. Specifically, the control portion 16 controls the conveying speed of the sheet Sh1 in the first conveying portion 11, the conveying speed of the sheet Sh1 in the second conveying portion 22, whether the sheet Sh1 should be conveyed or not (stopped), and the like.

The control portion 16 is mainly composed of a computer system including one or more processors and one or more memories. In the image processing apparatus 10, the functions of the control portion 16 are implemented by one or more processors executing programs. The programs may be stored in advance in the memories, may be provided through a telecommunications line such as the Internet, or may be provided by being stored in a non-transitory recording medium, such as an optical disk, readable by the computer system. The one or more processors are composed of one or more electronic circuits, including a semiconductor integrated circuit. Further, the computer system here includes a microcontroller having one or more processors and one or more memories. The control portion 16 includes a memory used as a temporary storage memory (work area) for various types of processing executed by the control portion 16. The control portion 16 may be a control portion provided separately from the main control portion which comprehensively controls the image processing apparatus 10.

In addition, the image processing apparatus 1 further includes a storage portion, a communication portion, and the like. The storage portion includes one or more nonvolatile memories, and stores in advance information, such as control programs, for causing the control portion 16 to execute various types of processing. The communication portion is an interface that executes data communication between the image processing apparatus 10 and an external apparatus connected via a communication network such as the Internet or a local area network (LAN).

In the present embodiment, among a plurality of extension devices 2, the extension device 2 as a finisher is directly connected to the main body 1, and the other extension devices 2 are indirectly connected to the main body 1 by being connected to the extension device 2 as a finisher. In other words, when the main body 1 is regarded as a "parent", the extension device 2 as a finisher can be regarded as a "child", and the other extension devices 2 can be regarded as "grandchildren". Thus, it is possible to add any function to the finisher by combining any device such as a folding machine or an inserter as another extension device 2 (grandchild enhancement) with the extension device 2 as a finisher (child enhancement). However, the plurality of extension devices 2 basically employ a common configuration insofar as the configuration to be described below is concerned.

As shown in FIG. 1, the extension device 2 includes an extended function portion 21 and the second conveying portion 22. In the present embodiment, as shown in FIG. 2, the extension device 2 includes a housing 102. The extended function portion 21 and the second conveying portion 22 are provided in the housing 102. Here, the housing 102 may be configured to have a plurality of extension devices 2 collectively provided in one housing 102, or be dividable (separable) for the respective extension devices 2.

The extended function portion 21 implements a function (post-processing) to be added to the main body 1 as the extension device 2. That is, when the extension device 2 is a stapling machine, the extended function portion 21 executes stapling processing, and when the extension device 2 is a folding machine, the extended function portion 21 executes sheet folding processing.

The second conveying portion 22 conveys the sheet Sh1 to be subjected to post-processing along a second conveying path L2 (see FIG. 3). As will be described in detail later, the second conveying portion 22 sequentially conveys sheets Sh1 to be subjected to post-processing with one or more roller pairs disposed on the second conveying path L2 formed in the extension device 2.

That is, the second conveying portion 22 conveys, along the second conveying path L2 in the extension device 2, the sheet Sh1 conveyed by the first conveying portion 11 of the main body 1 and discharged from the main body 1 to the extension device 2. Therefore, the first conveying path L1 of the main body 1 and the second conveying path L2 of the extension device 2 are continuous, and the sheet Sh1 is conveyed from the first conveying path L1 to the second conveying path L2. In other words, a conveying path L10 (see FIG. 3) includes the first conveying path L1 and the second conveying path L2, and the sheet Sh1 is conveyed along the conveying path L10 by the first conveying portion 11 and the second conveying portion 22.

The connecting work between the main body 1 and the extension device 2 is performed by the user (including a contractor such as a service person). That is, the user electrically connects, for example, a desired extension device 2 to the main body 1. In this way, the user performs the connecting work between the main body 1 and the extension device 2 in accordance with the configuration (combination) of the extension device 2 connected to the main body 1.

[2] Skew Correction of Sheet

In the image processing apparatus 10 as described above, when the sheet Sh1 conveyed by the second conveying portion 22 is skewed, the post-processing executed by the extension device 2 is performed on the sheet Sh1 in the skewed state. Therefore, it is useful for the image processing apparatus 10 to employ means for correcting the skew of the sheet Sh1.

The image processing apparatus 10 according to the present embodiment employs a mechanical registration mechanism as means for correcting the skew of the sheet Sh1. The mechanical registration mechanism is a mechanism for performing skew correction for correcting the skew itself of the conveyed sheet Sh1, using a registration roller 221 (see FIG. 3) disposed on the conveying path L10.

Specifically, the mechanical registration mechanism corrects the skew of the sheet Sh1 by causing the leading end of the sheet Sh1 conveyed along the conveying path L10 to collide with a nip portion of the registration roller 221 in a stopped state. The "leading end" of the sheet Sh1 here is an edge on the leading end (front end) side of the sheet Sh1 in the conveying direction, and is a part of the sheet Sh1 being conveyed which first reaches (comes into contact with) the registration roller 221. After adjusting the posture of the sheet Sh1 (correcting the skew) in this way, the mechanical registration mechanism corrects the skew of the conveyed sheet Sh1 by rotating the registration roller 221.

As related art of this type of image processing apparatus 10, there is known an image processing apparatus (image forming system) provided with a sheet conveying device that drives a registration roller after having the leading end of a sheet (paper) abut on a nip portion of the registration roller in a stopped state and correcting the skew of the sheet (paper skew correction). In the image processing apparatus according to the related art, a loop roller for deflecting a sheet is disposed upstream of the registration roller, and when the skew of the sheet is corrected, whether or not to stop the driving of the loop roller or whether or not to decelerate the driving of the loop roller is controlled depending on the type of the sheet.

In the configuration of the related art described above, when the basic conveying speed is high, a relatively long sheet is conveyed in a short time, and the deflection (loop) of the sheet tends to become unstable when correcting the skew of the sheet, which may cause damage to the sheet.

In contrast, in the present embodiment, when correcting the skew of the sheet Sh1, the image processing apparatus 10 can easily stabilize the deflection of the sheet Sh1 with the configuration to be described below.

That is, as shown in FIG. 3, the image processing apparatus 10 according to the present embodiment includes a registration roller 221, a first conveying roller 111, and a second conveying roller 112. The registration roller 221 is disposed on the conveying path L10 of the sheet Sh1 to be subjected to image processing, and corrects the skew of the sheet Sh1 by allowing the leading end of the sheet Sh1 to abut thereon in the stopped state. The first conveying roller 111 is disposed upstream of the registration roller 221 on the conveying path L10 at a position where a first loop space Sp1 is interposed between the first conveying roller 111 and the registration roller 221. The first loop space Sp1 is a space for deflecting the sheet Sh1. The first conveying roller 111 conveys the sheet Sh1 at a first conveying speed. The second conveying roller 112 is disposed upstream of the first conveying roller 111 on the conveying path L10 at a position where a second loop space Sp2 is interposed between the second conveying roller 112 and the first conveying roller 111. The second loop space Sp2 is a space for deflecting the sheet Sh1. The second conveying roller 112 conveys the sheet Sh1 at a second conveying speed that is equal to or higher than the first conveying speed.

In short, in the present embodiment, the first conveying roller 111 and the second conveying roller 112, which is further upstream of the first conveying roller 111 and conveys the sheet Sh1 at a conveying speed (second conveying speed) equal to or higher than that of the first conveying roller 111, are disposed upstream of the registration roller 221. The registration roller 221 allows the leading end of the sheet Sh1 to abut thereon in the stopped state, that is, in a state where the conveying speed is 0 (zero) and adjusts the posture of the sheet Sh1 (corrects the skew), and then starts to rotate, thereby constituting a mechanical registration mechanism that corrects the skew of the sheet Sh1.

The term "upstream" in the present disclosure means upstream in the flow of the sheet Sh1 being conveyed on the conveying path L10, and is opposite to downstream. That is, the sheet Sh1 conveyed along the conveying path L10 is conveyed from upstream to downstream of the conveying path L10. In addition, the term "loop" in the present disclosure refers to a loop-like deflection (slack) formed by the sheet Sh1 deflecting when the conveying speed of the leading end side of the sheet Sh1 is lower than the conveying speed of the trailing end side.

That is, basically, when the conveying speed of the upstream conveying roller (first conveying roller 111) is equal to or higher than the conveying speed of the downstream conveying roller (registration roller 221), a loop (deflection) may be generated between the first conveying roller 111 and the registration roller 221 due to the speed difference. Here, the conveying speed includes "0" as in the stopped state of the registration roller 221. Similarly, when the conveying speed of the upstream conveying roller (second conveying roller 112) is equal to or higher than the conveying speed of the downstream conveying roller (first conveying roller 111), a loop (deflection) may be generated between the second conveying roller 112 and the first conveying roller 111 due to the speed difference.

In the present embodiment, the first conveying roller 111 is disposed at a position upstream of the registration roller 221 across the first loop space Sp1 for forming a loop (deflection of the sheet Sh1) as described above. Similarly, the second conveying roller 112 is disposed at a position upstream of the first conveying roller 111 across the second loop space Sp2 for forming a loop (sheet Sh1).

Accordingly, a loop (deflection of the sheet Sh1) caused by the difference in conveying speed between the registration roller 221 and the first conveying roller 111 is generated in the first loop space Sp1, and a loop (deflection of the sheet Sh1) caused by the difference in conveying speed between the first conveying roller 111 and the second conveying roller 112 is generated in the second loop space Sp2. As a result, the deflection of the sheet Sh1 is distributed to two locations, and the amount of deflection of the sheet Sh1 per location is reduced, thereby reducing damage to the sheet Sh1. As described above, the image processing apparatus 10 according to the present embodiment has an advantage that the deflection of the sheet Sh1 is easily stabilized when the skew of the sheet Sh1 is corrected.

In addition, the image processing apparatus 10 according to the present embodiment includes the main body 1 and the extension device 2 as a post-processing device. The sheet Sh1 on which image processing (image formation or image reading) has been performed in the main body 1 is then conveyed from the main body 1 to the extension device 2 for post-processing. Therefore, in the image processing apparatus 10, the conveying path L10 of the sheet Sh1 has a first conveying path L1 formed in the main body 1, which is the upstream side, and a second conveying path L2 formed in the extension device 2, which is the downstream side.

In other words, the image processing apparatus 10 includes a downstream unit and an upstream unit. Here, the downstream unit has the registration roller 221, and the upstream unit has the first conveying roller 111. The conveying path L10 is formed to be continuous from the upstream unit to the downstream unit. In the present embodiment, as an example, the main body 1 is the upstream unit, and the extension device 2 is the downstream unit. Therefore, in the present embodiment, the registration roller 221 is provided in the extension device 2, and the first conveying roller 111 is provided in the main body 1. The conveying path L10 is formed to be continuous from the first conveying path L1 of the main body 1 to the second conveying path L2 of the extension device 2.

According to the above configuration, even if the sheet Sh1 is skewed when being conveyed from the upstream unit (the main body 1 in the present embodiment) to the downstream unit (the extension device 2 in the present embodiment), this skew can be corrected between the upstream unit and the downstream unit.

[3] Detailed Configurations of Conveying Portions

Next, configurations of the conveying portions (first conveying portion 11 and second conveying portion 22) which convey the sheet Sh1 will be described in more detail with reference to FIG. 3.

First, the first conveying portion 11 is provided in the main body 1, which is the upstream unit. The first conveying portion 11 includes the first conveying roller 111 and the second conveying roller 112, and conveys the sheet Sh1 along the first conveying path L1. In the example of FIG. 3, the first conveying path L1 extends in the left-right direction in the figure, and the first conveying portion 11 conveys the sheet Sh1 from the right side to the left side in the figure.

The first conveying roller 111 is disposed at the downstream end of the first conveying path L1, that is, at a position where the first conveying path L1 connects to the second conveying path L2 of the downstream unit (the extension device 2 in the present embodiment). In the present embodiment, as an example, a pair of first conveying rollers 111 are provided in the width direction (up-down direction in the figure) of the conveying path L10 (first conveying path L1) so as to nip the sheet Sh1 conveyed through the conveying path L10 (first conveying path L1). The pair of first conveying rollers 111 are in contact with each other with a predetermined pressure, and convey the sheet Sh1 toward the downstream side of the conveying path L10 (the registration roller 221 side) by nipping the sheet Sh1 therebetween. As long as at least one of the pair of first conveying rollers 111 is a drive roller driven by a motor, the other may be a driven roller.

The second conveying roller 112 is disposed a predetermined distance upstream from the first conveying roller 111 on the first conveying path L1. In the present embodiment, as an example, a pair of second conveying rollers 112 are provided in the width direction (up-down direction in the figure) of the conveying path L10 (first conveying path L1) so as to nip the sheet Sh1 conveyed through the conveying path L10 (first conveying path L1). The pair of second conveying rollers 112 are in contact with each other with a predetermined pressure, and convey the sheet Sh1 toward the downstream side of the conveying path L10 (the first conveying roller 111 side) by nipping the sheet Sh1 therebetween. As long as at least one of the pair of second conveying rollers 112 is a drive roller driven by a motor, the other may be a driven roller.

The first conveying path L1 has a width dimension (dimension in the up-down direction in the figure) slightly larger than the thickness of the sheet Sh1. Thus, the sheet Sh1 conveyed along the first conveying path L1 can pass through the first conveying path L1 and is guided in the traveling direction by the inner surface of the first conveying path L1. A part of the first conveying path L1 whose width dimension is partially enlarged functions as a second loop space Sp2.

The second loop space Sp2 is disposed between the first conveying roller 111 and the second conveying roller 112 on the first conveying path L1. That is, the second loop space Sp2 is located upstream when viewed from the first conveying roller 111 and downstream when viewed from the second conveying roller 112. In the present embodiment, as an example, the second loop space Sp2 has a triangular cross-sectional shape such that the width dimension (dimension in the up-down direction in the figure) increases toward the upstream side, and the width dimension gradually narrows toward the downstream side.

On the other hand, the second conveying portion 22 is provided in the extension device 2, which is the downstream unit. The second conveying portion 22 includes the registration roller 221 and an introduction sensor 222, and conveys the sheet Sh1 along the second conveying path L2. In the example of FIG. 3, the second conveying path L2 extends in the left-right direction in the figure, and the second conveying portion 22 conveys the sheet Sh1 from the right side to the left side in the figure.

The registration roller 221 is disposed a predetermined distance downstream from the upstream end of the second conveying path L2. In the present embodiment, as an example, a pair of registration rollers 221 are provided in the width direction (up-down direction in the figure) of the conveying path L10 (second conveying path L2) so as to nip the sheet Sh1 conveyed through the conveying path L10 (second conveying path L2). The pair of registration rollers 221 are in contact with each other with a predetermined pressure, and convey the sheet Sh1 toward the downstream side of the conveying path L10 by nipping the sheet Sh1 therebetween. As long as at least one of the pair of registration rollers 221 is a drive roller driven by a motor, the other may be a driven roller.

The second conveying path L2 has a width dimension (dimension in the up-down direction in the figure) slightly larger than the thickness of the sheet Sh1. Thus, the sheet Sh1 conveyed along the second conveying path L2 can pass through the second conveying path L2 and is guided in the traveling direction by the inner surface of the second conveying path L2. A part of the second conveying path L2 whose width dimension is partially enlarged functions as the first loop space Sp1.

The first loop space Sp1 is disposed at the upstream end of the second conveying path L2, that is, at a position where the second conveying path L2 connects to the first conveying path L1 of the upstream unit (the main body 1 in the present embodiment). That is, the first loop space Sp1 is positioned upstream when viewed from the registration roller 221, and downstream when viewed from the first conveying roller 111. Here, since the first loop space Sp1 is located at an introduction part (introduction port) of the sheet Sh1 in the second conveying path L2, the first loop space Sp1 is located immediately after the first conveying roller 111. In the present embodiment, as an example, the first loop space Sp1 has a triangular cross-sectional shape such that the width dimension (dimension in the up-down direction in the figure) increases toward the upstream side, and the width dimension gradually narrows toward the downstream side.

The introduction sensor 222 is a sensor for detecting the sheet Sh1 introduced into the second conveying path L2. In the present embodiment, as an example, the introduction sensor 222 is an optical sensor, and is disposed at a position facing the conveying path L10 (second conveying path L2). Here, the introduction sensor 222 is disposed between the registration roller 221 and the first loop space Sp1 on the second conveying path L2. That is, the introduction sensor 222 is located upstream when viewed from the registration roller 221, and downstream when viewed from the first loop space Sp1.

The second conveying portion 22 stops the registration roller 221 after the leading end of the sheet Sh1 conveyed to the second conveying path L2 by the first conveying portion 11 is detected by the introduction sensor 222, until a stop time required for generation of a loop (deflection of the sheet Sh1) necessary for skew correction elapses. Thus, the leading end of the sheet Sh1 conveyed by the first conveying portion 11 abuts on the registration roller 221 in the stopped state, causing a loop in the sheet Sh1 and executing skew correction. Thereafter, the second conveying portion 22 accelerates the registration roller 221 to a predetermined conveying speed, and conveys the sheet Sh1 with the registration roller 221.

[4] Sheet Conveying Operation

Figure 4:
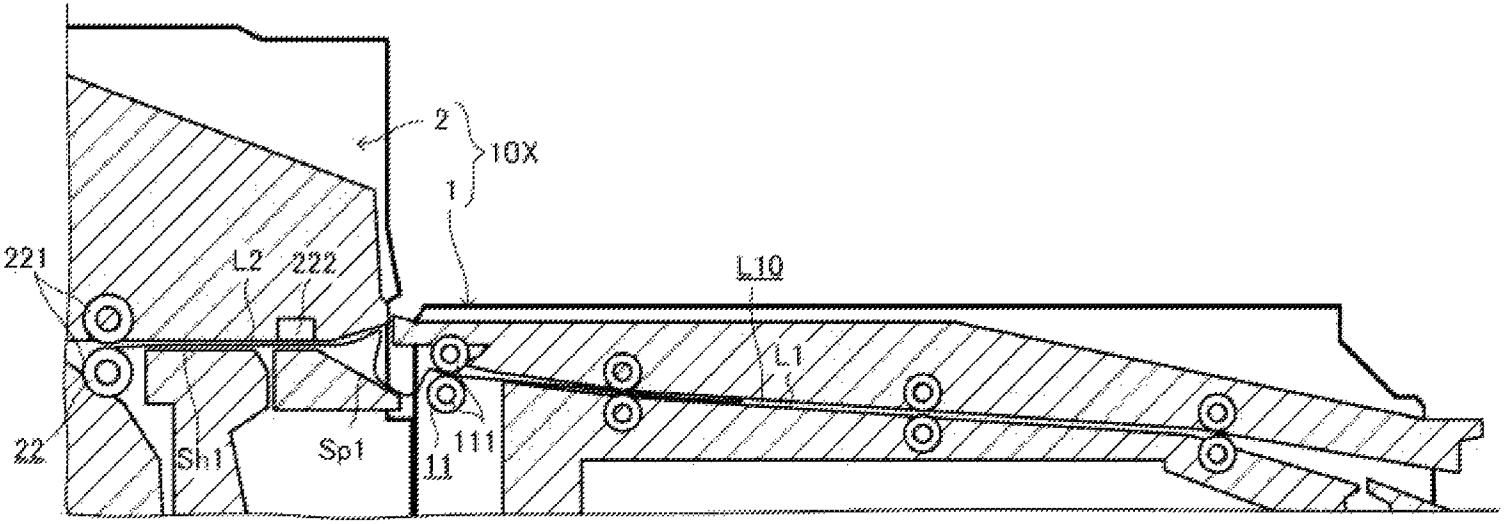
FIG. 4 is a schematic cross-sectional view showing a main part of an image processing apparatus according to a comparison example.

Next, the sheet conveying operation of the image processing apparatus 10 according to the present embodiment will be described in detail by comparing it with an image processing apparatus 10X according to a comparative example. The image processing apparatus 10X according to the comparative example differs from the image processing apparatus 10 according to the present embodiment in that the second loop space Sp2 and the second conveying roller 112 are omitted from the image processing apparatus 10 according to the present embodiment as shown in FIG. 4.

That is, the image processing apparatus 10X according to the comparative example includes the registration roller 221 and the first conveying roller 111. The registration roller 221 is disposed on the conveying path L10 of the sheet Sh1 to be subjected to image processing, and corrects the skew of the sheet Sh1 by allowing the leading end of the sheet Sh1 to abut thereon in the stopped state. The first conveying roller 111 is disposed upstream of the registration roller 221 on the conveying path L10 at a position where the first loop space Sp1 is interposed between the first conveying roller 111 and the registration roller 221.

When the mechanical registration correction is completed in the main body 1, the conveying roller upstream of the registration roller 221 is also stopped while the registration roller 221 is stopped, thereby suppressing the generation of the loop more than necessary. However, in the configuration in which the main body 1 and the extension device 2 are separated as in the comparative example, for example, there is a problem when the conveying roller (the first conveying roller 111 or the like) of the main body 1, which is the upstream unit, is stopped while the sheet Sh1 is located at the fixing device, so that the conveying roller of the main body 1 does not stop even while the registration roller 221 of the extension device 2, which is the downstream unit, is stopped.

Therefore, in the image processing apparatus 10X according to the comparative example, the first conveying roller 111 continues to convey the sheet Sh1 while the second conveying portion 22 stops the registration roller 221, until a predetermined stop time elapses after the leading end of the sheet Sh1 is detected by the introduction sensor 222. At this time, only a loop (deflection of the sheet Sh1) having a length necessary for skew correction is generated in the first loop space Sp1.

Thereafter, the second conveying portion 22 accelerates the registration roller 221 to a predetermined conveying speed, and conveys the sheet Sh1 with the registration roller 221. At this time, acceleration control is performed to increase the conveying speed (number of rotations) of the registration roller 221 in steps from 0 (stopped state) to a predetermined speed so as to prevent the motor that drives the registration roller 221 from stepping out. Therefore, during the acceleration period in which the registration roller 221 is accelerated, the length of the sheet Sh1 conveyed from the first conveying roller 111 on the upstream side is longer than the length of the sheet Sh1 sent out from the registration roller 221. Therefore, during the acceleration period, the loop (deflection of the sheet Sh1) is extended (increased) in the first loop space Sp1 by a length corresponding to the difference in length.

Figure 5:
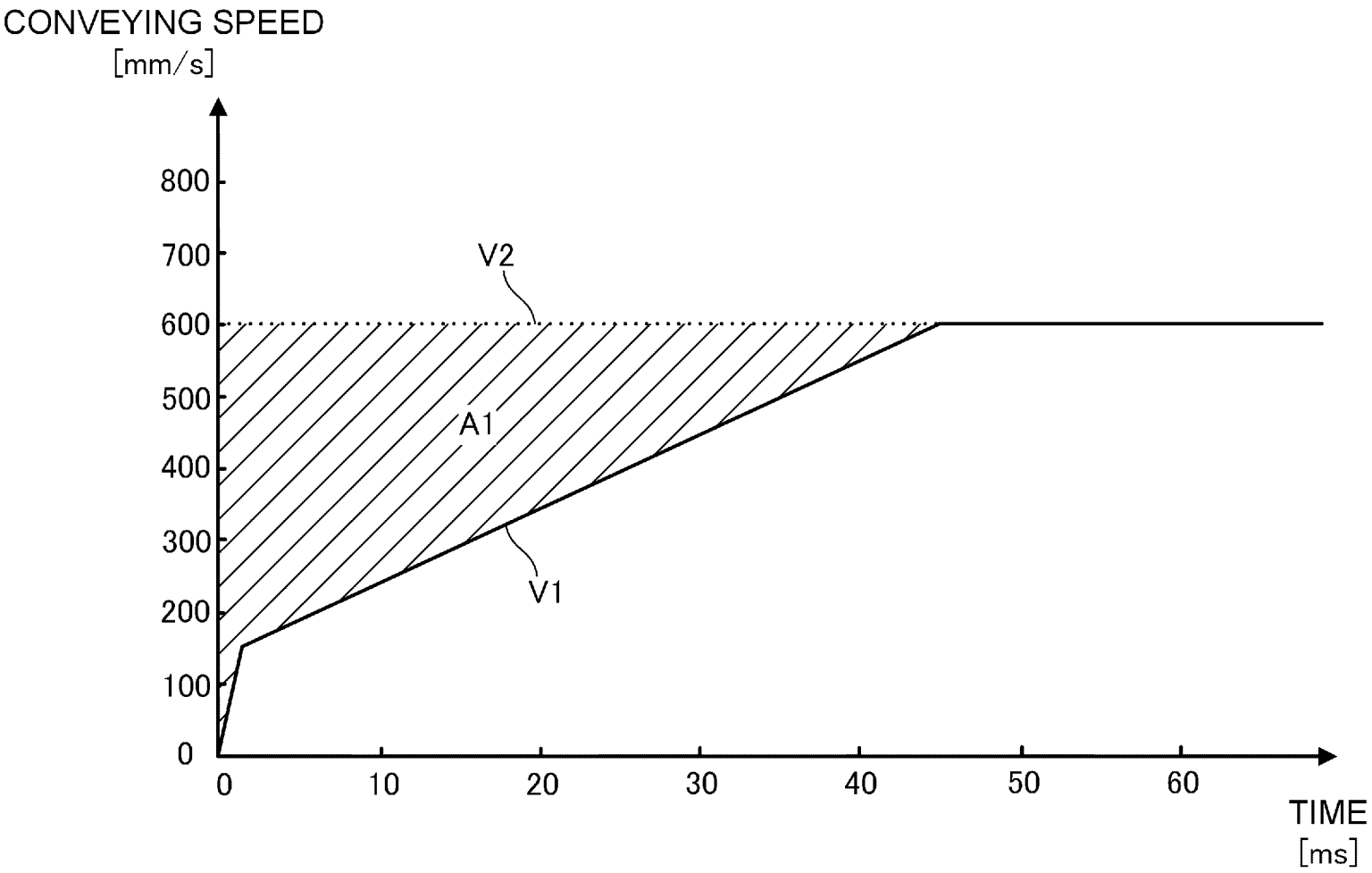
FIG. 5 is a diagram schematically showing the extension of the loop during an acceleration period of a registration roller in the image processing apparatus according to the comparative example.

FIG. 5 is a diagram schematically showing the extension of the loop during the acceleration period of the registration roller 221 with respect to the image processing apparatus 10X according to the comparative example. In FIG. 5, the horizontal axis represents the time elapsed from the start of the acceleration period (i.e., the release of the stopped state of the registration roller 221), and the vertical axis represents the conveying speed.

During the acceleration period, the conveying speed V1 of the registration roller 221 gradually increases with time and finally reaches a predetermined speed V2. The predetermined speed V2 is the same as the conveying speed of the first conveying roller 111 upstream of the registration roller 221. As an example, when the predetermined speed V2 is 600 [mm/s], as shown in FIG. 5, during the acceleration period, the difference between the conveying speed V1 of the registration roller 221 and the conveying speed (predetermined speed V2) of the first conveying roller 111 on the upstream side causes the loop to extend in the first loop space Sp1 by a length corresponding to the difference, that is, by a length corresponding to the hatched area A1 in FIG. 5. Therefore, at the end of the acceleration period, a longer loop is generated in the first loop space Sp1, which consists of a loop having a length necessary for skew correction and a loop having a length corresponding to the hatched area A1.

As a result, a relatively large loop space (first loop space Sp1) is required between the registration roller 221 and the first conveying roller 111. If the loop space is small, as shown in FIG. 4, the sheet Sh1 may curve significantly, which may cause damage, such as a crease, to the sheet Sh1. On the contrary, if the loop space is large, the push of the sheet Sh1 into the registration roller 221 necessary for skew correction becomes insufficient, leading to a decrease in the accuracy of the skew correction of the sheet Sh1.

On the other hand, in the image processing apparatus 10 according to the present embodiment, the first conveying roller 111 continues to convey the sheet Sh1 while the second conveying portion 22 stops the registration roller 221, until a predetermined stop time elapses after the leading end of the sheet Sh1 is detected by the introduction sensor 222. In the present embodiment, at the same time when the registration roller 221 stops, the conveying speed (first conveying speed V11) of the first conveying roller 111 is reduced (decelerated) from the same speed as the conveying speed (second conveying speed V12) of the second conveying roller 112. However, the first conveying roller 111 is not stopped, but only decelerated.

At this time, only a loop (deflection of the sheet Sh1) having a length necessary for skew correction is generated in the first loop space Sp1. Further, in the second loop space Sp2, a loop (deflection of the sheet Sh1) having a length corresponding to the difference between the reduced conveying speed (first conveying speed V11) of the first conveying roller 111 and the conveying speed (second conveying speed V12) of the second conveying roller 112 located upstream thereof is generated. In short, in the image processing apparatus 10 according to the present embodiment, since the second loop space Sp2 is provided, a loop is generated not only in the first loop space Sp1 but also in the second loop space Sp2.

Thereafter, the second conveying portion 22 accelerates the registration roller 221 to a predetermined conveying speed, and conveys the sheet Sh1 with the registration roller 221. At this time, acceleration control is performed to increase the conveying speed (number of rotations) of the registration roller 221 in steps from 0 (stopped state) to a predetermined speed so as to prevent the motor that drives the registration roller 221 from stepping out. Therefore, during the acceleration period in which the registration roller 221 is accelerated, the length of the sheet Sh1 conveyed from the first conveying roller 111 on the upstream side is longer than the length of the sheet Sh1 sent out from the registration roller 221. Therefore, during the acceleration period, the loop (deflection of the sheet Sh1) is extended (increased) in the first loop space Sp1 by a length corresponding to the difference in length.

Furthermore, in the present embodiment, the first conveying roller 111 starts accelerating at the same time as the registration roller 221 or with a certain amount of time difference. That is, where the first conveying speed V11 of the first conveying roller 111 is decelerated as the registration roller 221 is stopped, the first conveying speed V11 is accelerated as the registration roller 221 is accelerated. The first conveying speed V11 is accelerated to the first conveying speed V11 (i.e., the second conveying speed V12) before deceleration (i.e., before the registration roller 221 is stopped). Therefore, during the acceleration period of the registration roller 221, the loop (deflection of the sheet Sh1) is extended (increased) in the second loop space Sp2 by a length corresponding to the difference between the first conveying speed V11 and the second conveying speed V12.

Figure 6:
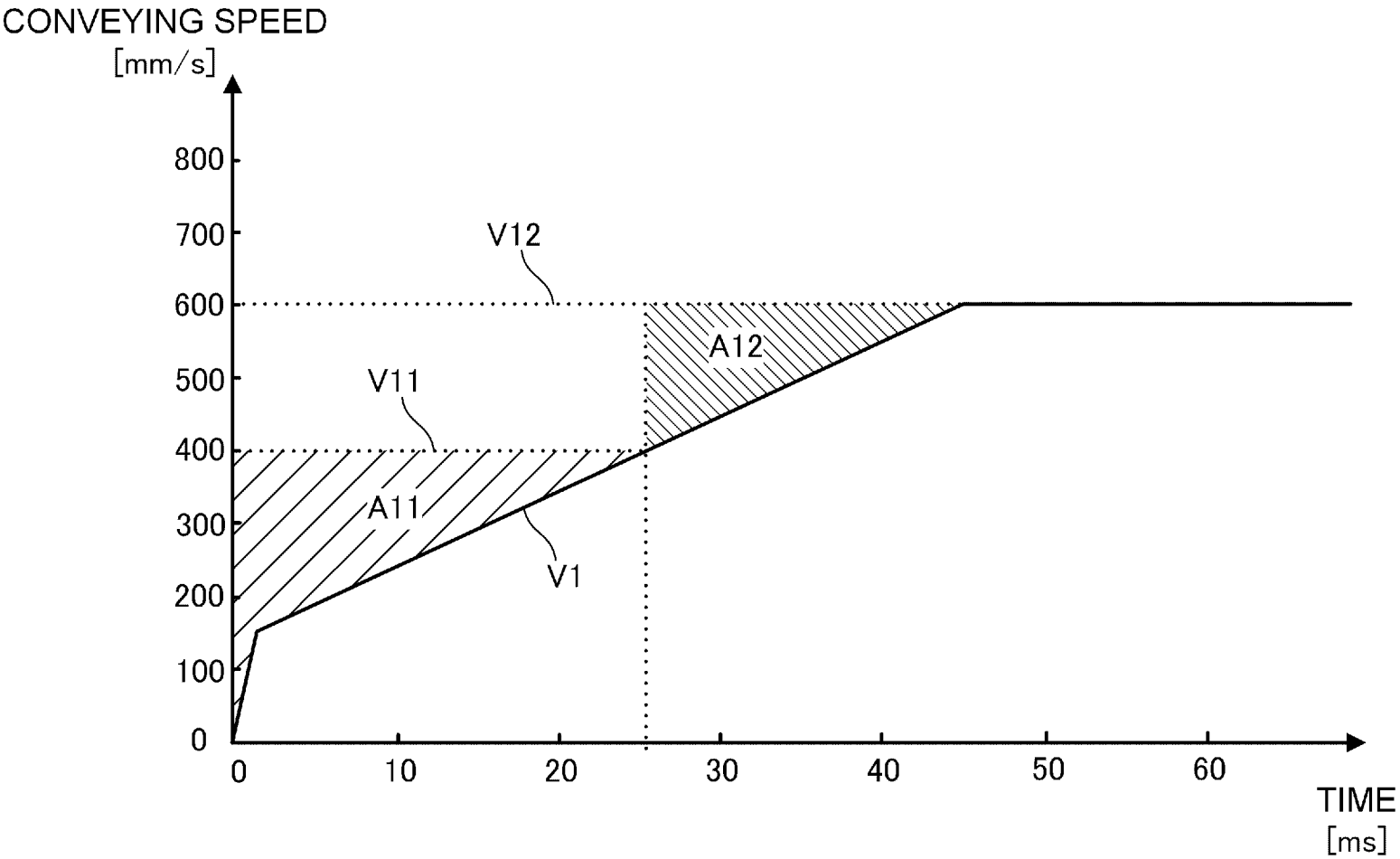
FIG. 6 is a diagram schematically showing the extension of the loop during an acceleration period of a registration roller in the image processing apparatus according to the first embodiment.

FIG. 6 is a diagram schematically showing the extension of the loop during the acceleration period of the registration roller 221 with respect to the image processing apparatus 10 according to the present embodiment. In FIG. 6, the horizontal axis represents the time elapsed from the start of the acceleration period (i.e., the release of the stopped state of the registration roller 221), and the vertical axis represents the conveying speed.

During the acceleration period, the conveying speed V1 of the registration roller 221 gradually increases with time and finally reaches the second conveying speed V12. In addition, during the acceleration period, the first conveying speed V11 of the first conveying roller 111 gradually increases with time and finally reaches the second conveying speed V12. In the present embodiment, acceleration of the first conveying speed V11 is started when the conveying speed V1 of the registration roller 221 reaches the first conveying speed V11. As an example, it is assumed that the second conveying speed V12 is 600 [mm/s] and the first conveying speed V11 after deceleration is 400 [mm/s].

In this case, as shown in FIG. 6, during the acceleration period, the difference between the conveying speed V1 of the registration roller 221 and the conveying speed (first conveying speed V11) of the first conveying roller 111 on the upstream side causes the loop to extend in the first loop space Sp1 by a length corresponding to the difference, that is, by a length corresponding to the hatched area A11 in FIG. 6. In addition, during the acceleration period, the difference between the conveying speed (first conveying speed V11) of the first conveying roller 111 and the conveying speed (second conveying speed V12) of the second conveying roller 112 on the upstream side causes the loop to extend in the second loop space Sp2 by a length corresponding to the difference, that is, by a length corresponding to the hatched area A12 in FIG. 6.

Accordingly, at the end of the acceleration period, a loop is generated in the first loop space Sp1, which consists of a loop having a length necessary for skew correction and a loop having a length corresponding to the hatched area A11. In addition, a loop is generated in the second loop space Sp2, which consists of a loop having a length corresponding to the difference between the decelerated first conveying speed V11 and the second conveying speed V12 and a loop having a length corresponding to the hatched area A12.

As is clear from comparison of FIG. 6 with FIG. 5, the image processing apparatus 10 according to the present embodiment can keep the extended length of the loop generated during the acceleration period shorter than in the image processing apparatus 10X according to the comparative example. That is, the extended length of the loop can be shortened by the difference between the hatched area A1 and the hatched areas A11 and A12. Moreover, since the loop having the length corresponding to the hatched areas A11 and A12 is generated in a dispersed manner in the first loop space Sp1 and the second loop space Sp2, the loop generated in one loop space is significantly shorter than in the comparative example.

As a result, according to the image processing apparatus 10 of the present embodiment, there is an advantage that the deflection of the sheet Sh1 is easily stabilized when correcting the skew of the sheet Sh1.

In addition, in the present embodiment, as described above, the conveying speed of the first conveying roller 111 (the first conveying speed V11) is variable. That is, the first conveying roller 111 can change the first conveying speed V11. Accordingly, the length of the loop generated in the first loop space Sp1 and the length of the loop generated in the second loop space Sp2 can be appropriately adjusted using the first conveying speed V11.

Moreover, in the present embodiment, the first conveying roller 111 changes the first conveying speed V11 in accordance with the conveying speed V1 of the registration roller 221. That is, the first conveying speed V11 changes in synchronization with the conveying speed V1 of the registration roller 221. Specifically, the first conveying speed V11 is decelerated as the registration roller 221 stops, and is accelerated as the registration roller 221 is accelerated. This allows the first conveying roller 111 to function as a buffer between the registration roller 221 and the second conveying roller 112 and effectively shorten the loop.

In particular, in the present embodiment, during the acceleration period from when the registration roller 221 is in the stopped state to when the registration roller 221 reaches the predetermined conveying speed (second conveying speed V12), the deflection length of the sheet Sh1 generated in the first loop space Sp1 due to the difference between the conveying speeds of the registration roller 221 and the first conveying roller 111 is larger than the deflection length of the sheet Sh1 generated in the second loop space Sp2 due to the difference between the first conveying speed V11 and the second conveying speed V12. That is, by adjusting the first conveying speed V11 during the acceleration period, the hatched area A11 is made larger than the hatched area A12 in FIG. 6. This allows the loop in the second loop space Sp2 to be kept relatively small, and allows the second loop space Sp2 itself to be kept small.

Further, in the present embodiment, the second conveying roller 112 accelerates the second conveying speed V12 after the sheet Sh1 passes through the image processing portion (the image reading portion 12 and/or the image forming portion 13) that performs image processing on the sheet Sh1. That is, the conveying speed (second conveying speed V12) of the second conveying roller 112 is also not constant, and can be accelerated within a range in which it does not affect the image processing portion of the main body 1. This makes it possible to shorten the time required for the sheet Sh1 to be discharged (to the extension device 2).

Figure 7:
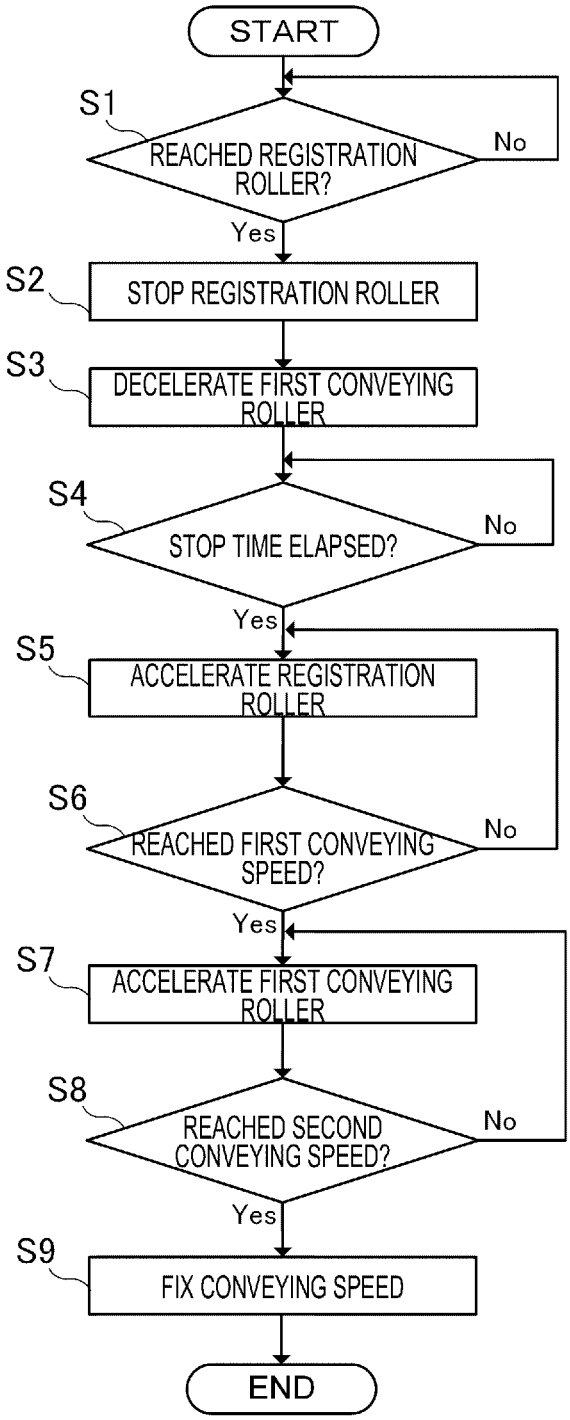
FIG. 7 is a flowchart showing an example of the operation of the image processing apparatus according to the first embodiment.

An example of the procedure of an operation particularly relating to the conveyance of the sheet Sh1 of the image processing method executed by the image processing apparatus 10 (mainly the control portion 16) will be described below with reference to FIG. 7. Here, steps S1, S2, . . . in the flowchart shown in FIG. 7 represent the numbers of the processing procedure (steps) executed by the image processing apparatus 10.

<Step S1>

In step S1, the image processing apparatus 10 determines whether or not the leading end of the sheet Sh1 has reached the registration roller 221. When the sheet Sh1 discharged from the first conveying path L1 of the main body 1 is introduced into the second conveying path L2 of the extension device 2, the introduction sensor 222 detects the leading end of the sheet Sh1. With this, the image processing apparatus 10 determines that the leading end of the sheet Sh1 has reached the registration roller 221 (S1: Yes), and shifts the processing to step S2. On the other hand, when the introduction sensor 222 does not detect the leading end of the sheet Sh1, the image processing apparatus 10 determines that the leading end of the sheet Sh1 has not reached the registration roller 221 (S1: No), and shifts the processing to step S1.

<Steps S2 and S3>

In step S2, the image processing apparatus 10 stops the registration roller 221. In addition, in step S3, the image processing apparatus 10 reduces the conveying speed (first conveying speed V11) of the first conveying roller 111. Thus, the leading end of the sheet Sh1 conveyed by the decelerated first conveying roller 111 abuts on the registration roller 221 in the stopped state, causing a loop in the sheet Sh1 to execute skew correction.

<Steps S4 and S5>

In step S4, the image processing apparatus 10 determines whether or not a predetermined stop time has elapsed after the stop of the registration roller 221. The stop time is a time for a loop (deflection of the sheet Sh1) having a length necessary for skew correction to be generated in the first loop space Sp1. If the stop time has not elapsed (S4: No), the image processing apparatus 10 shifts the processing to step S4. If the stop time has elapsed (S4: Yes), the image processing apparatus 10 shifts the processing to step S5. In step S5, the image processing apparatus 10 accelerates the registration roller 221. Thus, the registration roller 221 in the stopped state is gradually accelerated, and the sheet Sh1 is conveyed by the registration roller 221.

<Steps S6 and S7>

In step S6, the image processing apparatus 10 determines whether or not the conveying speed V1 of the registration roller 221 accelerated from the stopped state has reached the first conveying speed V11. If the conveying speed V1 of the registration roller 221 has not reached the first conveying speed V11 (S6: No), the image processing apparatus 10 shifts the processing to step S5 and continues the acceleration of the registration roller 221. When the conveying speed V1 of the registration roller 221 reaches the first conveying speed V11 (S6: Yes), the image processing apparatus 10 shifts the processing to step S7. In step S7, the image processing apparatus 10 accelerates the first conveying roller 111. Thus, the decelerated first conveying speed V11 is gradually accelerated.

<Steps S8 and S9>

In step S8, the image processing apparatus 10 determines whether or not the first conveying speed V11 of the first conveying roller 111 accelerated from the decelerated state has reached the second conveying speed V12. If the first conveying speed V11 has not reached the second conveying speed V12 (S8: No), the image processing apparatus 10 shifts the processing to step S7 and continues the acceleration of the first conveying roller 111. When the first conveying speed V11 reaches the second conveying speed V12 (S8: Yes), the image processing apparatus 10 shifts the processing to step S9. In step S9, the image processing apparatus 10 stops the acceleration of the registration roller 221 and the first conveying roller 111, and fixes the conveying speed V1 of the registration roller 221 and the first conveying speed V11.

The operation described above makes it possible to realize an image processing method that can easily stabilize the deflection of the sheet Sh1 when correcting the skew of the sheet Sh1. The procedure of the image processing method described above is merely an example, and the order of the processes shown in the flowchart of FIG. 7 may be changed as appropriate.

[5] Modifications

The plurality of constituent elements included in the image processing apparatus 10 may be distributed across a plurality of housings. For example, the control portion 16 may be provided separately from the first conveying portion 11 or the like, or may be provided in the extension device 2 or the like other than the main body 1.

In addition, in the first embodiment, the control portion 16 of the main body 1 comprehensively controls the first conveying portion 11 of the main body 1 and the second conveying portion 22 of the extension device 2, but the present disclosure is not limited to this configuration. For example, a control unit portion may be provided in the extension device 2 separately from the control portion 16 of the main body 1, and the second conveying portion 22 may be controlled by this control portion.

In addition, as long as the first loop space Sp1 is located between the registration roller 221 and the first conveying roller 111, it is not necessarily provided in the second conveying path L2 of the extension device 2, and may be provided in the first conveying path L1 of the main body 1. That is, the first loop space Sp1 may be located downstream of the first conveying roller 111 in the first conveying path L1.

In addition, the shape of each of the first loop space Sp1 and the second loop space Sp2 is not limited to a triangular cross-sectional shape, and various shapes such as a square cross-sectional shape or an elliptical cross-sectional shape can be adopted. Further, each of the first loop space Sp1 and the second loop space Sp2 may be divided into a plurality of parts. That is, for example, a plurality of first loop spaces Sp1 may be arranged between the registration roller 221 and the first conveying roller 111, and a plurality of second loop spaces Sp2 may be arranged between the first conveying roller 111 and the second conveying roller 112.

In addition, the registration roller 221, the first conveying roller 111, and the second conveying roller 112 are not limited to the configuration in which a pair of each is provided, and one or three or more of each may be provided. Further, a plurality of pairs of each of the registration roller 221, the first conveying roller 111, and the second conveying roller 112 may be provided.

Second Embodiment

Figure 8:
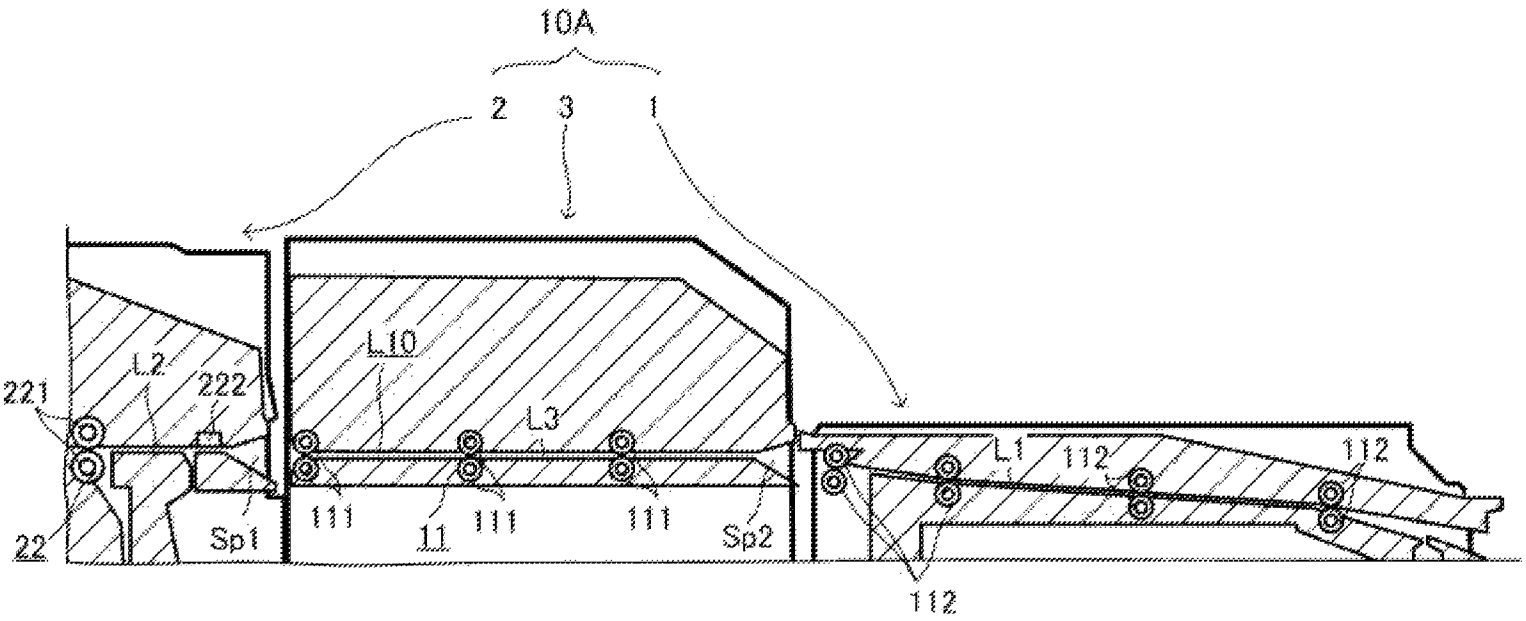
FIG. 8 is a schematic cross-sectional view showing a main part of an image processing apparatus according to a second embodiment.

An image processing apparatus 10A according to the present embodiment differs from the image processing apparatus 10 according to the first embodiment in that it includes a relay conveying unit 3 as shown in FIG. 8. In the following, structures similar to those of the first embodiment are denoted by common reference numerals, and descriptions thereof are omitted as appropriate.

The relay conveying unit 3 is located between the main body 1 and the extension device 2, which is the post-processing device. In the image processing apparatus 10A according to the present embodiment, the sheet Sh1 discharged from the main body 1 is conveyed to the extension device 2 via the relay conveying unit 3. That is, the relay conveying unit 3 has a function of relaying the sheet Sh1 from the main body 1 to the extension device 2. In the present embodiment, focusing on the relationship between the extension device 2 and the relay conveying unit 3, the extension device 2 is a downstream unit, and the relay conveying unit 3 is an upstream unit. In addition, focusing on the relationship between the relay conveying unit 3 and the main body 1, the relay conveying unit 3 is a downstream unit, and the main body 1 is an upstream unit.

Here, the first conveying portion 11 is separately provided in the main body 1 and the relay conveying unit 3. Specifically, a third conveying path L3 is formed in the relay conveying unit 3, and the first conveying path L1 of the main body 1 and the second conveying path L2 of the extension device 2 are continuously connected by the third conveying path L3. That is, the conveying path L10 has the first conveying path L1, the third conveying path L3, and the second conveying path L2 in this order from the upstream side.

In the present embodiment, the first conveying portion 11 has a plurality of pairs of first conveying rollers 111 and a plurality of pairs of second conveying rollers 112. A plurality of pairs (three pairs as an example) of the first conveying rollers 111 are disposed on the third conveying path L3 of the relay conveying unit 3, and a plurality of pairs (four pairs as an example) of the second conveying rollers 112 are disposed on the first conveying path L1 of the main body 1. A second loop space Sp2 is provided between the plurality of pairs of first conveying rollers 111 and the plurality of pairs of second conveying rollers 112, as in the first embodiment. In the present embodiment, as an example, the second loop space Sp2 is disposed at the upstream end of the third conveying path L3, that is, at a position where the third conveying path L3 connects to the first conveying path L1 of the upstream unit (the main body 1 in the present embodiment). Here, since the second loop space Sp2 is located at an introduction part (introduction port) of the sheet Sh1 in the third conveying path L3, the second loop space Sp2 is located immediately after the second conveying roller 112.

Also in the image processing apparatus 10A according to the present embodiment, there is an advantage that the deflection of the sheet Sh1 is easily stabilized when correcting the skew of the sheet Sh1, as in the first embodiment.

As a modification of the second embodiment, the registration roller 221 may be provided in the relay conveying unit 3. In this case, the mechanical registration correction is executed in the relay conveying unit 3. In addition, another extension device 2 may be installed between the relay conveying unit 3 and the extension device 2. In addition, the second loop space Sp2 may be formed in the main body 1 instead of the relay conveying unit 3, or may be formed so as to be dispersed in the relay conveying unit 3 and the main body 1. In addition, only one pair of the first conveying rollers 111 and one pair of the second conveying rollers 112 may be provided. The configuration (including the modification) of the second embodiment can be applied in combination with each configuration (including the modification) described in the first embodiment.

APPENDIXES OF INVENTION

The following are appendixes to the overview of the invention extracted from the above embodiments. It is noted that the structures and processing functions to be described in the following appendixes can be selected and combined arbitrarily.

[Appendix 1]

An image processing apparatus comprising:

a registration roller disposed on a conveying path of a sheet to be subjected to image processing and configured to correct a skew of the sheet by allowing a leading end of the sheet to abut thereon in a stopped state;

a first conveying roller disposed upstream of the registration roller on the conveying path at a position where a first loop space for deflecting the sheet is interposed between the first conveying roller and the registration roller and configured to convey the sheet at a first conveying speed; and a second conveying roller disposed upstream of the first conveying roller on the conveying path at a position where a second loop space for deflecting the sheet is interposed between the second conveying roller and the first conveying roller and configured to convey the sheet at a second conveying speed that is equal to or higher than the first conveying speed.

[Appendix 2]

The image processing apparatus according to Appendix 1, comprising:

a downstream unit including the registration roller; and an upstream unit including the first conveying roller, wherein the conveying path is formed to be continuous from the upstream unit to the downstream unit.

[Appendix 3]

The image processing apparatus according to Appendix 1 or 2, wherein the second conveying roller accelerates the second conveying speed after the sheet passes through an image processing portion configured to perform the image processing on the sheet.

[Appendix 4]

The image processing apparatus according to any one of Appendixes 1 to 3, wherein during an acceleration period from when the registration roller is in the stopped state to when the registration roller reaches a predetermined conveying speed, a deflection length of the sheet generated in the first loop space due to a difference in conveying speed between the registration roller and the first conveying roller is larger than a deflection length of the sheet generated in the second loop space due to a difference between the first conveying speed and the second conveying speed.

[Appendix 5]

The image processing apparatus according to any one of Appendixes 1 to 4, wherein the first conveying roller is capable of changing the first conveying speed.

[Appendix 6]

The image processing apparatus according to Appendix 5, wherein the first conveying roller changes the first conveying speed in accordance with a conveying speed of the registration roller.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image processing method comprising:

driving a registration roller disposed on a conveying path of a sheet to be subjected to image processing and configured to correct a skew of the sheet by allowing a leading end of the sheet to abut thereon in a stopped state;

driving a first conveying roller disposed upstream of the registration roller on the conveying path at a position where a first loop space for deflecting the sheet is interposed between the first conveying roller and the registration roller and configured to convey the sheet at a first conveying speed; and driving a second conveying roller disposed upstream of the first conveying roller on the conveying path at a position where a second loop space for deflecting the sheet is interposed between the second conveying roller and the first conveying roller and configured to convey the sheet at a second conveying speed that is equal to or higher than the first conveying speed.

2. The image processing method according to claim 1, wherein the conveying path is formed to be continuous from an upstream unit including the first conveying roller to a downstream unit including the registration roller.

3. The image processing method according to claim 1, wherein the second conveying speed is accelerated after the sheet passes through an image processing portion configured to perform the image processing on the sheet.

4. The image processing method according to claim 1, wherein during an acceleration period from when the registration roller is in the stopped state to when the registration roller reaches a predetermined conveying speed, a deflection length of the sheet generated in the first loop space due to a difference in conveying speed between the registration roller and the first conveying roller is larger than a deflection length of the sheet generated in the second loop space due to a difference between the first conveying speed and the second conveying speed.

5. The image processing method according to claim 1, wherein the first conveying speed is changeable.

6. The image processing method according to claim 5, wherein the first conveying speed is changed in accordance with a conveying speed of the registration roller.

* * * * *